US010780010B2

(12) United States Patent
Kondrukevich et al.

(10) Patent No.: US 10,780,010 B2
(45) Date of Patent: Sep. 22, 2020

(54) REDUCED FRICTION SURFACE AND METHOD OF USE

(71) Applicants: Aleksandr Kondrukevich, Brooklyn, NY (US); Maksim Kondrukevich, Staten Island, NY (US)

(72) Inventors: Aleksandr Kondrukevich, Brooklyn, NY (US); Maksim Kondrukevich, Staten Island, NY (US)

( * ) Notice: Subject to any disclaimer, the term of this patent is extended or adjusted under 35 U.S.C. 154(b) by 573 days.

(21) Appl. No.: 15/601,010

(22) Filed: May 22, 2017

(65) Prior Publication Data

US 2018/0333320 A1 Nov. 22, 2018

(51) Int. Cl.

*A61H 15/00* (2006.01)
*A61H 1/02* (2006.01)
*A63B 21/00* (2006.01)

(52) U.S. Cl.

CPC ..... *A61H 1/02* (2013.01); *A61H 1/0222* (2013.01); *A61H 1/0292* (2013.01); *A63B 21/4029* (2015.10); *A61H 2001/0203* (2013.01); *A61H 2015/0064* (2013.01); *A61H 2015/0071* (2013.01); *A61H 2201/1623* (2013.01); *A61H 2201/1678* (2013.01); *A61H 2203/0456* (2013.01); *A61H 2205/081* (2013.01)

(58) Field of Classification Search

CPC .. A61H 1/02; A61H 15/00; A61H 2015/0064; A61H 2015/0007; A61H 2015/0042; A61H 7/002; A61H 15/02; A61H 2201/1623; A61H 2201/0119; A63B 21/4029

USPC ..... 601/136

See application file for complete search history.

(56) References Cited

U.S. PATENT DOCUMENTS 5,263,474 A * 11/1993 Agader ..... A61H 15/00 601/113
5,393,287 A * 2/1995 Papapaschalis ..... A61H 15/00 482/142
6,245,000 B1 * 6/2001 Saakian ..... A61H 15/00 482/142
2005/0197602 A1 * 9/2005 Kwen ..... A47C 7/021 601/131
2015/0122611 A1 * 5/2015 Lykkegaard ..... B65G 11/081 193/17

FOREIGN PATENT DOCUMENTS

KR 2005107102 A * 5/2004

OTHER PUBLICATIONS

Tomum, Set of 6pcs CY-25D Bolt Type 1" Nylon Ball Transfer Bearing Unit Table Conveyor Roller Ball with bolt for Transmission, Furniture, Wheelchair, 2016, https://www.amazon.com/TOMUM-Transfer-Transmission-Furniture-Wheelchair/dp/B01M4KTOZF/ref=sr_1_1?keywords=transfer+ball&qid=1572893824&sr=8-1 (Year: 2016).*

* cited by examiner

*Primary Examiner* — Samchuan C Yao
*Assistant Examiner* — Matthew Standard
(74) *Attorney, Agent, or Firm* — Lawrence G. Fridman, Esq; Feigin & Fridman, LLC

(57) ABSTRACT

A plurality of ball transfer units is used together to form a reduced friction surface. The reduced friction surface lies on a base, and is particularly useful for carrying out a physical activity on, or applying force to, a body part on the surface so as to stretch the muscles and stretch and/or decompress the spine.

18 Claims, 12 Drawing Sheets

REDUCED FRICTION SURFACE AND METHOD OF USE

FIELD AND BACKGROUND OF THE DISCLOSED TECHNOLOGY

The disclosed technology relates generally to reduced friction massage surfaces and devices, and, more specifically to massage surfaces formed utilizing multiple ball transfer units and method of use.

As known, a healthy spine is formed of bony vertebrae, which are interconnected by intervertebral joints and are held together by intervertebral ligaments. Between the vertebrae are disposed intervertebral discs formed of a fibrous tissue, which perform a damping function. The spine is retained in a normal state by a muscular framework supporting the vertebrae, joints, ligaments, and discs.

With age, for natural reasons as well as due to increased loads and a variety of other reasons, the muscular framework supporting the spine weakens. Consequently, the load on the intervertebral joints increases, and the mobility of the intervertebral joints and of the spine in general is impaired. Additionally, the intervertebral discs often become thinner and their damping function may deteriorate or be lost. As a result, the load on the vertebrae increases, causing the spine to compress and shorten. The damage to the spine and spinal cord and impaired movement of the spine and body, may result in various types of muscular dysfunction and/or dysfunction of the internal organs.

Decompression or stretching of the spine, as achieved, for example, by use of massage and massage surfaces, removes some of the load from the spine and helps improve or restore the function of the spinal cord. Consequently, stretching of the spine may also improve or restore muscular mobility and may strengthen the muscular framework supporting the spine. As such, decompression of the spine may be the start of a process of normalizing the function of the spine and restoring disturbed functions of the human body.

Stretching of the spine over a massage surface, requires motion of the body over the surface. As is well known in the laws of physics, a frictional force exists between a moving object and a surface on which the object is moving. As such, in order to move an object lying on a surface, one must overcome the frictional force by making an effort, or apply a force, greater than the frictional force. As the frictional force decreases, the force required to move the object also decreases.

Many different methods and devices have been proposed for reducing the frictional force between a moving object and a surface on which the object is moving. Some such methods and devices make use of balls to reduce the friction.

U.S. Pat. No. 5,096,308 to Sundseth is directed to ball units including a load-bearing ball seated in an essentially radially symmetric bearing units having ball bearings in a bearing shell. The load-bearing ball is held in the bearing unit by a securing apparatus. The bearing unit has a supporting structure that enables the bearing unit to be fixed in an opening of a carrier plate in such a way that it can support a load. Detents are provided to lock the unit in the opening against the load direction.

U.S. Pat. No. 3,466,697 relates to a spring-loaded ball transfer or caster unit, which includes means for releasably securing the ball unit to structures with which the ball unit is associated, and/or means serving to limit movement of the ball responsive to a load applied to the ball. Such ball transfer units are usable in a pallet or platform for moving a container or box, as on a conveyer belt.

However, there is a need in the art for massage surfaces which reduce the friction between the body of the person being massaged and the massage surface, to allow for easier and more effective stretching of the person's spine.

SUMMARY OF THE DISCLOSED TECHNOLOGY

The disclosed technology relates generally to massage surfaces and devices, and, more specifically to massage surfaces and devices formed utilizing multiple ball transfer units.

In accordance with an aspect of one embodiment of the present invention, there is provided a ball transfer unit including:

a housing element including:

an elongate stem terminating, at one end thereof, in a base portion having a concave upper surface; and a cylindrical portion extending from the base portion around the concave upper surface and forming a hollow cup;

a coating disposed within the hollow cup at least on the concave upper surface, the coating formed of a material having a low friction coefficient;

a plurality of ball bearings disposed within the hollow cup in engagement with the coating; and a motion transfer ball disposed at least partially within the hollow cup in engagement with the plurality of ball bearings, wherein the motion transfer ball is free to rotate in any direction relative to the hollow cup with substantially no friction.

In accordance with another aspect of one embodiment of the present invention, there is provided a reduced friction device for applying force to a body part of a human, the device including:

a base frame; and a reduced friction surface mounted onto the base frame, the reduced friction surface including a plurality of ball transfer units each including a housing element housing a motion transfer ball, the plurality of ball transfers units arranged such that adjacent ones of the plurality of ball transfer units engage one another, wherein each of the motion transfer balls is adapted for omnidirectional rotation relative to a corresponding the housing element and independently of other the motion transfer balls, wherein the reduced friction surface is adapted to have the body part placed thereon during performing of a physical activity applying force to the body part, while reducing friction between the body part and the surface.

In some embodiments, each of the plurality of ball transfer unit includes:

the housing element, which includes:

an elongate stem terminating, at one end thereof, in a base portion having a concave upper surface; and a cylindrical portion extending from the base portion around the concave upper surface and forming a hollow cup;

a coating disposed within the hollow cup at least on the concave upper surface, the coating formed of a material having a low friction coefficient;

a plurality of ball bearings disposed within the hollow cup in engagement with the coating; and the motion transfer ball disposed at least partially within the hollow cup in engagement with the plurality of ball bearings, wherein the motion transfer ball is free to rotate in any direction relative to the hollow cup with substantially no friction.

In some embodiments, a diameter of the elongated stem is significantly smaller than a diameter of the base portion.

In some embodiments, a diameter of the motion transfer ball is commensurable with the size of the vertebral discs and intervertebral distances. In some embodiments, the diameter of the motion transfer ball is within the range of 15 mm to 40 mm.

In some embodiments, the coating is formed of at least one of metal, plastic, wood, glass, bone, or a combination thereof.

In some embodiments, a diameter of each of said ball bearings is in the range of 2 mm to 6 mm.

In some embodiments, a ratio between the diameter of the motion transfer ball and the diameters of the ball bearings is in the range of 5:1 to 20:1.

In some embodiments, each of the motion transfer ball, or the single motion transfer ball of one ball transfer unit, is formed of at least one of metal, plastic, wood, glass, bone, or a combination thereof.

In some embodiments, all the motion transfer balls are formed of the same material, the same material being selected from the group consisting of metal, plastic, wood, glass, bone, or a combination thereof.

In some embodiments, all the motion transfer balls have an equal diameter.

In some embodiments, the reduced friction surface includes a plurality of ball transfer unit blocks, each ball transfer unit block including a subset of the plurality of ball transfer units mounted onto a bracket, in each the ball transfer unit block, adjacent ones of the subset of ball transfer units engage one another, and the plurality of ball transfer unit blocks are arranged such that, for each first and second adjacent ball transfer unit blocks, that at least some of the ball transfer units of the first ball transfer unit block engage at least some of the ball transfer units of the second ball transfer unit block.

In some embodiments, the physical activity includes at least one of massage, sports exercise, medical exercise, muscle rehabilitation exercise, joint rehabilitation exercise, spinal decompression, and post-traumatic rehabilitation.

In some embodiments, the plurality of ball transfer units is arranged such that the body part placed on the surface engages only the motion transfer balls and does not engage the housing elements.

In some embodiments, the ball transfer units are arranged such that a load of the body part is substantially equally distributed among ones of the motion transfer balls disposed beneath the body part.

In some embodiments, the reduced friction surface includes a concave surface or a convex surface.

In some embodiments, the reduced friction surface is a planar surface.

In some embodiments, the reduced friction surface is angled at an acute angle with respect to the horizon.

In accordance with a further aspect of one embodiment of the present invention, there is provided a method for constructing a reduced friction device for use during physical activity applying force to a body part of a human, the method including:

obtaining a plurality of groups of ball transfer units as described hereinabove;

for each group in the plurality of groups, placing the stem of each the ball transfer unit in the group in a corresponding bore in a bracket, thereby to form a plurality of ball transfer unit blocks, wherein, in each the ball transfer unit blocks, adjacent ones of the ball transfer units engage one another; and mounting the plurality of ball transfer unit blocks onto a surface frame such that for each first and second adjacent ones of the plurality of ball transfer unit blocks, at least one ball transfer unit of the first block engages at least one ball transfer unit of the second block, thereby to form a reduced friction surface.

In accordance with yet another aspect of one embodiment of the present invention, there is provided a method for treating a body part of a human subject, the method including:

constructing a reduced friction device as described hereinabove;

placing the body part of the human subject on the reduced friction surface; and while the body part engages the reduced friction surface, performing a physical activity on the body part.

In some embodiments, performing a physical activity includes performing at least one of massage, sports exercise, medical exercise, muscle rehabilitation exercise, joint rehabilitation exercise, gravitational spinal decompression, and post-traumatic rehabilitation exercise.

In some embodiments the method further includes, prior to the placing the body part, angling the reduced friction surface relative to the horizon, and wherein the performing a physical activity includes performing the physical activity while the reduced friction surface is angled relative to the horizon.

In some embodiments, the force applied to the body part when the reduced friction surface is angled relative to the horizon is a gravitational force.

DETAILED DESCRIPTION OF EMBODIMENTS OF THE DISCLOSED TECHNOLOGY

Figure 1A:
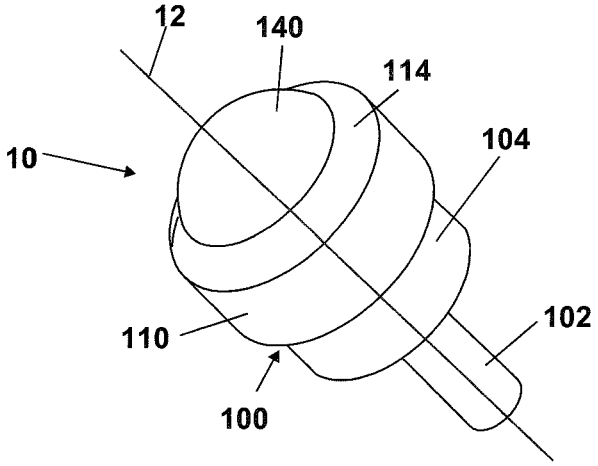
FIGS. 1A, 1B, 1C, 1D, and 1E are, respectively, a perspective view illustration, a top plan view illustration, a side plan view illustration, a bottom plan view illustration, and a sectional illustration, of a ball transfer unit according to an embodiment of the disclosed technology.
Figure 1B:
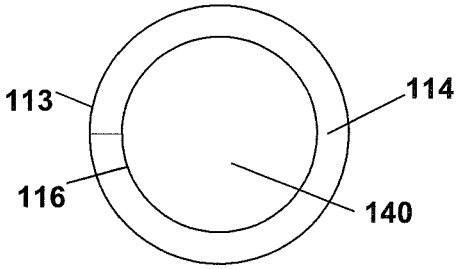
Figure 1C:
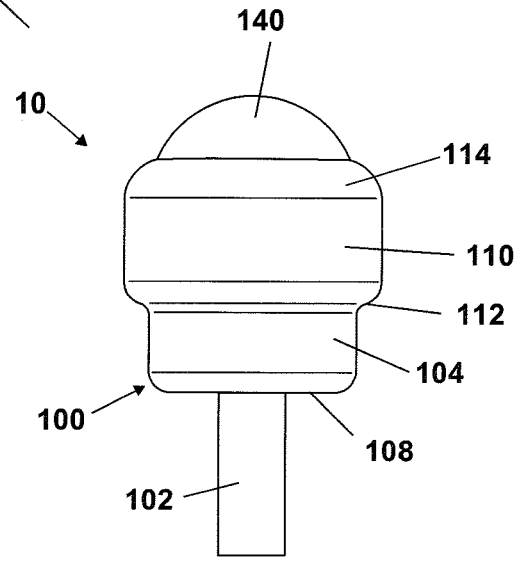
Figure 1E:
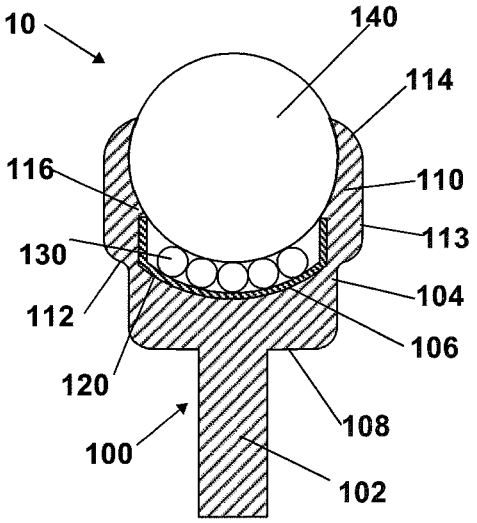
Figure 1D:
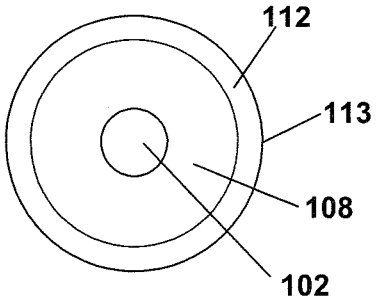

In an embodiment of the disclosed technology, a plurality of ball transfer units are used together to form a reduced friction surface. The reduced friction surface lies on a base, and is particularly useful for carrying out a physical activity on, or applying force to, a body part on the surface. For example, the body part may be massaged while on the reduced friction surface, or may be stretched so as to decompress the spine. Carrying out the physical activity on the reduced friction surface is particularly advantageous in that little friction is present thereby allowing for movement while applying less force, and the mass of the body part is distributed on the ball transfer units, and is spread out thereby, which is advantageous when stretching muscles or decompressing the spine.

According to an aspect of some embodiments of the teachings herein, there is provided a reduced friction device for applying force to a body part of a human, the device including a base frame, and a reduced friction surface mounted onto the base frame, the reduced friction surface including a plurality of ball transfer units each including a housing element housing a motion transfer ball, the plurality of ball transfers units arranged such that adjacent ones of the plurality of ball transfer units engage one another, wherein each of the motion transfer balls is adapted for omnidirectional rotation relative to a corresponding the housing element and independently of other the motion transfer balls, and wherein the reduced friction surface is adapted to have the body part placed thereon during performing of a physical activity applying force to the body part, while reducing friction between the body part and the surface.

Embodiments of the disclosed technology will become clearer in view of the following description of the drawings.

Reference is now made to FIGS. 1A, 1B, 1C, 1D, and 1E, which are, respectively, a perspective view illustration, a top plan view illustration, a side plan view illustration, a bottom plan view illustration, and a sectional illustration, of a ball transfer unit according to an embodiment of the disclosed technology.

As seen, a ball transfer unit 10 is arranged about a longitudinal axis 12, and, in some embodiments, is symmetrical with respect to the longitudinal axis. Ball transfer unit 10 includes a housing element 100 formed with an elongate stem 102 arranged along the longitudinal axis 12. The stem 102 is terminated at an upper end thereof, in a base portion 104. In some embodiments, such as the illustrated embodiments, the stem 102 is generally cylindrical.

The base portion 104 extends from stem 102 to a concave upper surface 106, which, in some embodiments, may have a circular cross section. Typically, a diameter of the base portion 104 is significantly greater than a diameter of stem 102, such that an annular shoulder 108 forms where stem 102 is connected to the lower surface of base portion 104. This is particularly important in order to arrange, or pack, the ball transfer units very close to one another, as described in further detail hereinbelow. For example, a ratio between the diameter of stem 102 and the diameter of base portion 104 may be at most 1:2, at most 1:3, or at most 1:4. The specific ration between the diameter of stem 102 and the diameter of base portion 104 affects the overall weight of the housing element 100. Extending upwardly from base portion 104, about concave upper surface 106, is a cylindrical portion 110, having a diameter equal to, or slightly greater than the diameter of base portion 104, such that an annular shoulder 112 forms where base portion 104 is connected to the cylindrical portion 110. In some embodiments, such as the illustrated embodiment, the shoulder 112 may be slanted relative to the longitudinal axis 12. Cylindrical portion 110 includes an outer wall 113, which terminates, at an upper end thereof, in a lip 114, which may be inwardly curved or slanted relative to the longitudinal axis 12. Concave upper surface 106, together with inner wall 116 of cylindrical portion 110, form a hollow cup.

A coating 120 is disposed within the hollow cup on concave upper surface 106, and, in some embodiments, on a lower portion of inner wall 116. The coating 120 must be smooth so as to allow ball bearing engaged therewith to roll on the coating 120. In some embodiments, the coating 120 may be formed of a material having a low friction coefficient, such as metal, plastic, wood, glass, bone, or a combination thereof. In some embodiments, the hardness of the coating should be equal to or greater than the hardness of the material from which the ball bearings are formed, to avoid deformation of the coating during use.

A plurality of ball bearings 130 are disposed within the hollow cup, and engage the coating 120 at concave upper surface 106. A motion transfer ball 140 is placed within the hollow cup above ball bearings 130 and rests thereon, without engaging inner wall 116 of cylindrical portion 110. At least a portion of the motion transfer ball 140 extends out of the housing element 100, above lip 114. Motion transfer ball 140 is free to rotate in any direction (omnidirectional rotation) relative to the hollow cup, with substantially no friction, due to its rolling on ball bearings 130 which engage and roll over coating 120.

In some embodiments, concavity of inner wall 116 also ensures that motion transfer ball 140 cannot "pop out" of the housing element 100.

In some embodiments, the motion transfer ball 140 is formed of at least one of metal, plastic, wood, glass, bone, or a combination thereof.

In some embodiments, a diameter of the motion transfer ball 140 is commensurable with the size of the vertebral discs and intervertebral distances. In some embodiments, the diameter of the motion transfer ball 140 is within the range of 15 mm to 40 mm. In some embodiments, a diameter of each ball bearing 130 is within the range of 2 mm to 6 mm. In some embodiments, a ratio between the diameter of each ball bearing 130 and the diameter of motion transfer ball 140 is in the range of 1:5 to 1:20.

Figure 2A:
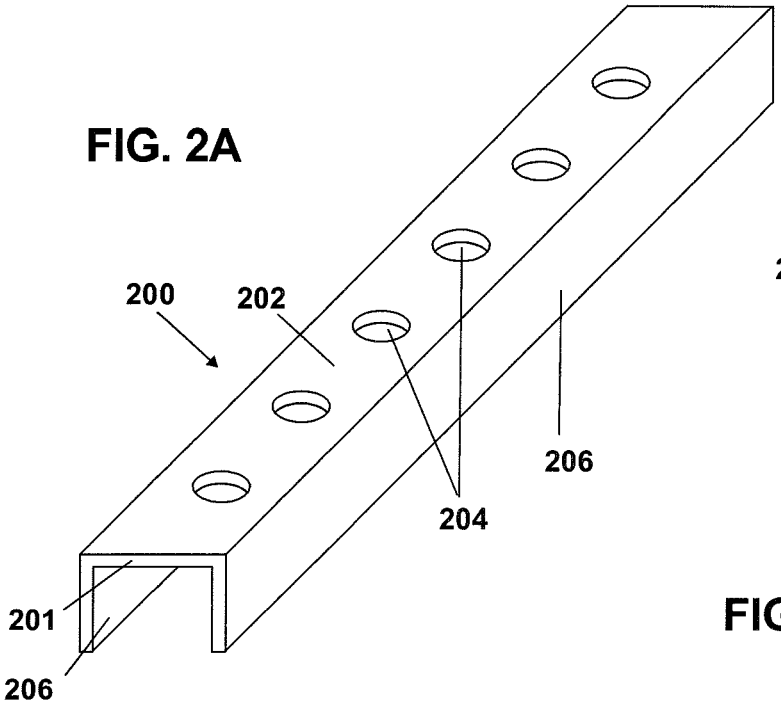
FIGS. 2A and 2B are, respectively, a perspective view illustration and a top plan view illustration of a bracket for housing a plurality of ball transfer units according to an embodiment of the disclosed technology.
Figure 2B:
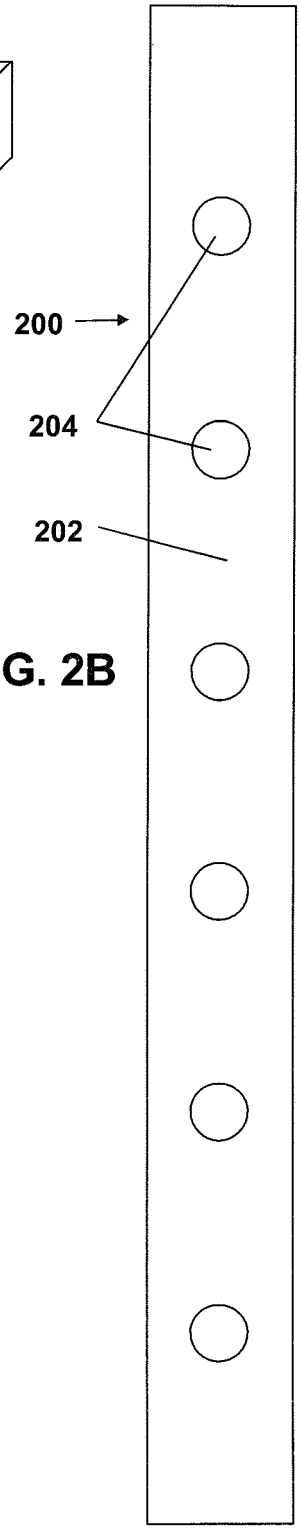

Reference is now made to FIGS. 2A and 2B, which are, respectively, a perspective view illustration and a top plan view illustration of a bracket suitable for housing a plurality of ball transfer units 10 according to an embodiment of the disclosed technology.

As seen in FIGS. 2A and 2B, a bracket 200 includes a receiving portion 201 defining an outer surface 202, the receiving portion 201 including a plurality of through-going receiving bores 204, and at least one support 206 which supports the bracket 200 when standing on a base surface. The receiving bores 204 are typically circular, and have a circumference greater than the circumference of stem 102 (FIGS. 1A to 1E) and smaller than the circumference of base portion 104 of a ball transfer unit 10.

In some embodiments, such as the embodiment illustrated in FIGS. 2A and 2B, the receiving bores 204 are arranged in a single line, and the receiving surface comprises an elongate strip. In other embodiments (not shown), the receiving bores 204 may be arranged in multiple lines, a matrix, a square, a rectangle, or any other suitable arrangement. The shape of the receiving portion 201 and of surface 202 is selected to accommodate the arrangement of the receiving bores 204. In some embodiments, the distance from one receiving bore 204 to a second, adjacent receiving bore 204, is fixed.

In the embodiment illustrated in FIG. 2A, the support 206 includes two support walls, extending from edges of the receiving portion 201 along an elongate side thereof. However, in other embodiments the support 206 may include four support walls extending from all four edges of the receiving portion, or any other configuration of support walls disposed along edges of the receiving portion. In some embodiments, the support 206 may include, in addition to support walls, a support base (not shown). In general, any suitable configuration of the support 206 is considered to be within the scope of the present invention, provided that the support 206 does not block the receiving bores 204 or interfere with the ability to accommodate stems 102 of ball transfer units 10 in the bores 204.

Reference is now made to FIGS. 3A, 3B, 3C, and 3D, which are, respectively, a perspective view illustration, a narrow side plan view illustration, a broad side plan view illustration, and a top plan view illustration of a ball transfer unit block 300 including bracket 200 of FIGS. 2A and 2B having housed therein a plurality of ball transfer units 10 of FIGS. 1A to 1E.

Figure 3B:
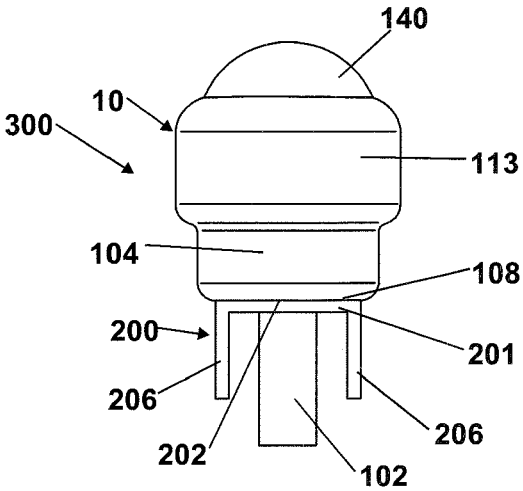
FIGS. 3A, 3B, 3C, and 3D are, respectively, a perspective view illustration, a narrow side plan view illustration, a broad side plan view illustration, and a top plan view illustration of a ball transfer unit block including the bracket of FIGS. 2A and 2B having housed therein ball transfer units of FIGS. 1A to 1E.
Figure 3A:
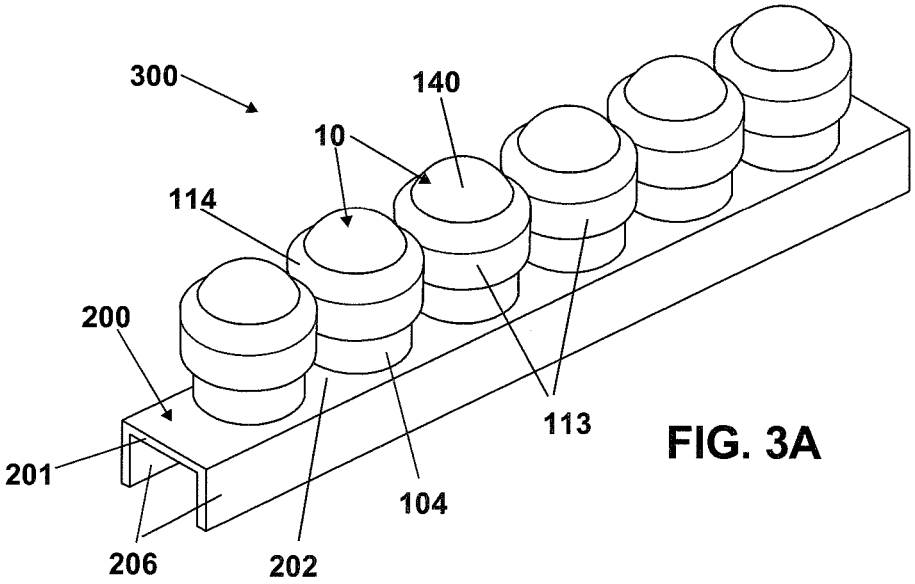

As seen in the Figures, ball transfer unit block 300 includes a plurality of ball transfer units 10 disposed in bracket 200 such that stems 102 are received within receiving bores 204. In some embodiments, annular shoulders 108 of ball transfer units 10 engage surface 202 of receiving portion 201, as seen in FIGS. 3A and 3B. In other embodiments, the stems 102 are supported such that annular shoulders 108 are disposed above, and are spaced from, the outer surface 202 of the receiving portion 201. Since the motion transfer balls 140 of the ball transfer units 10 do not engage one another, each motion transfer ball 140 is capable of omnidirectional rotation relative to the housing element and independently of other motion transfer balls in the block.

Figure 3C:
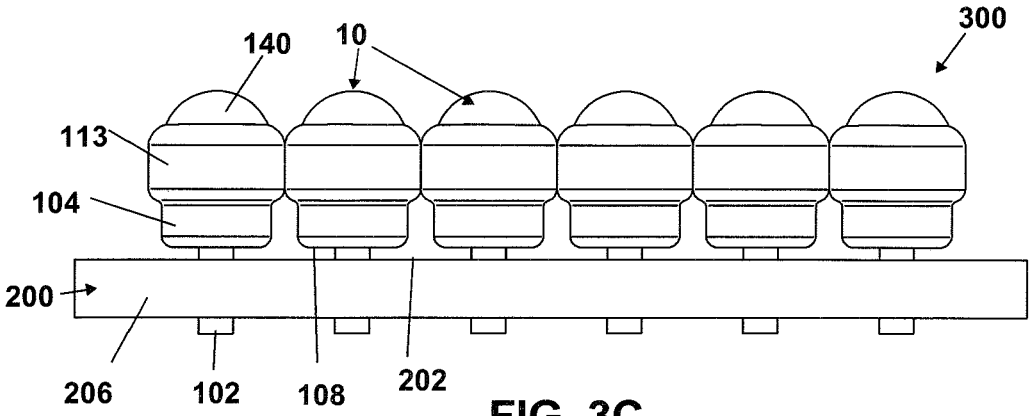
Figure 3D:
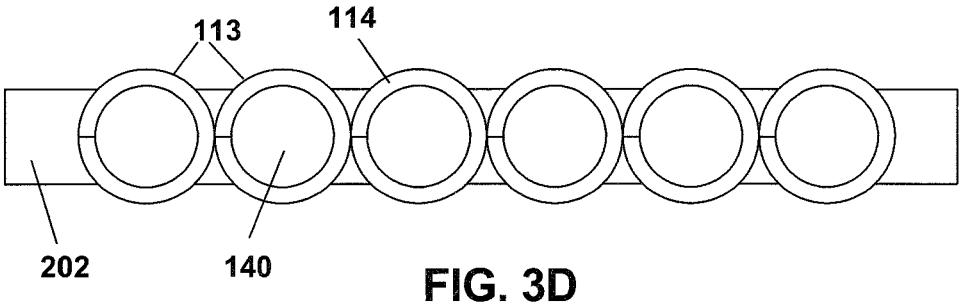

It is a particular feature of the present invention that the receiving bores 204 are spaced such that the outer walls 113 of adjacent ball transfer units 10 engage one another, as seen clearly in FIGS. 3C and 3D. Additionally, as seen clearly in FIG. 3C, all the ball transfer units 10 are at a uniform height, when disposed in bracket 200. This is particularly important for even load distribution on the ball transfer units, as explained in detail hereinbelow.

Each ball transfer unit 10 is fixed to bracket 200 by means of a nut, welding, glue or other means suitable for fixing housing element 100 of the ball transfer unit 10 to the bracket without restricting the movement of the ball bearings 130 or motion transfer ball 140.

In some embodiments, all the motion transfer balls 140 in the block 300 are formed of the same material. In some embodiments, all the motion transfer balls 140 in the block 300 have the same diameter.

Figure 4:
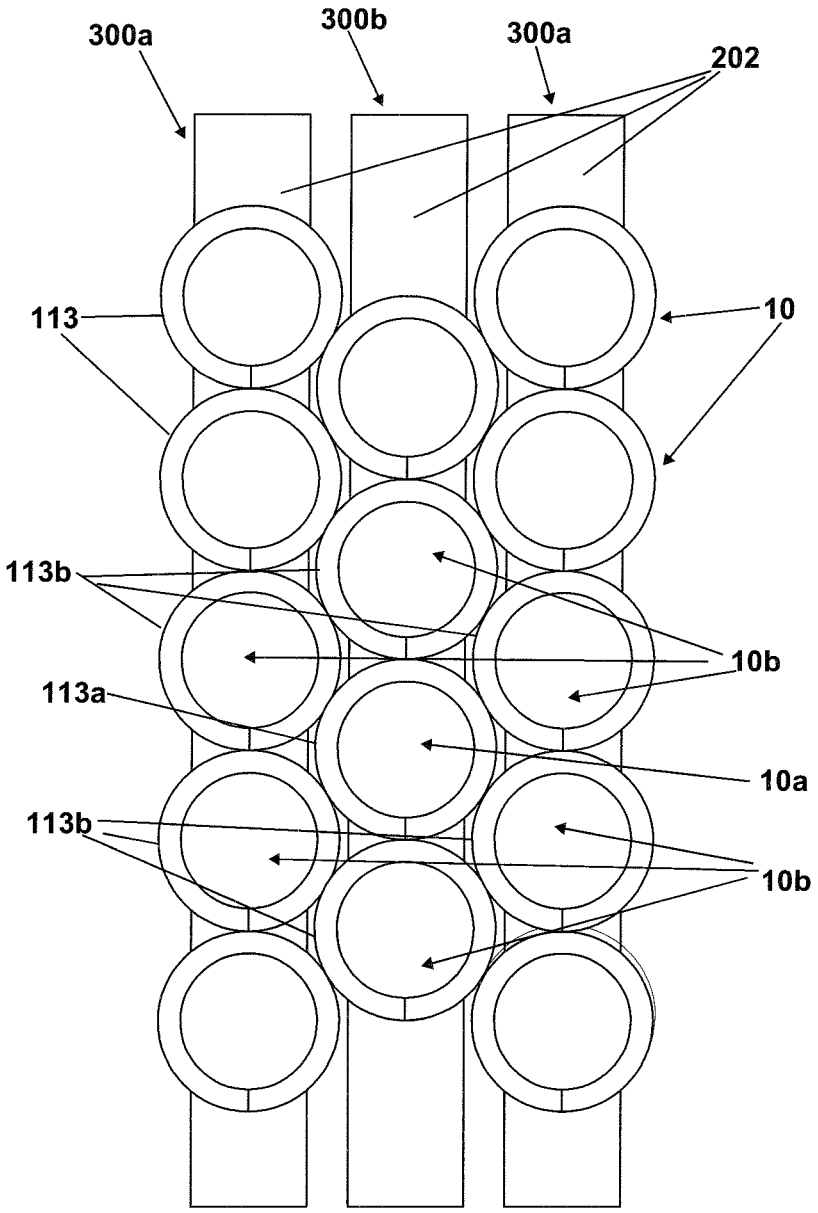
FIG. 4 is a top plan view illustration of a surface formed of a plurality of ball transfer unit blocks of FIGS. 3A to 3D according to an embodiment of the disclosed technology.

Reference is now made to FIG. 4, which is a top plan view illustration of a surface formed of a plurality of ball transfer unit blocks 300 of FIGS. 3A to 3D according to an embodiment of the disclosed technology.

As seen in FIG. 4, the brackets 200 of the ball transfer unit blocks 300 are arranged in parallel to one another, and are sufficiently close to one another such that outer walls 113 of adjacent ball transfer units 10 engage one another.

In some embodiments, the ball transfer unit blocks 300 are arranged such that empty space between ball transfer units 10 will be minimized. In one such embodiment, illustrated in FIG. 4, the outer wall 113*a* of a specific ball transfer unit 10*a* engages outer walls 113*b* of six neighboring ball transfer units 10*b*, in a honeycomb like structure. In such embodiments, some of the ball transfer unit blocks 300 may have a greater number of ball transfer units than others. In the illustrated embodiment, ball transfer unit blocks 300*a* each include five ball transfer units, whereas ball transfer unit block 300*b* includes four ball transfer units.

Reference is now made to FIGS. 5A, 5B, 5C, and 5D, which are perspective view illustrations of a ball transfer unit block 300 mounted onto a base frame, according to four different embodiments of the present invention. As seen, in each of FIGS. 5A to 5D, a single ball transfer unit block 300 including a plurality of ball transfer units 10 is mounted onto a base frame 500 including two frame walls disposed in parallel to one another.

Figure 5A:
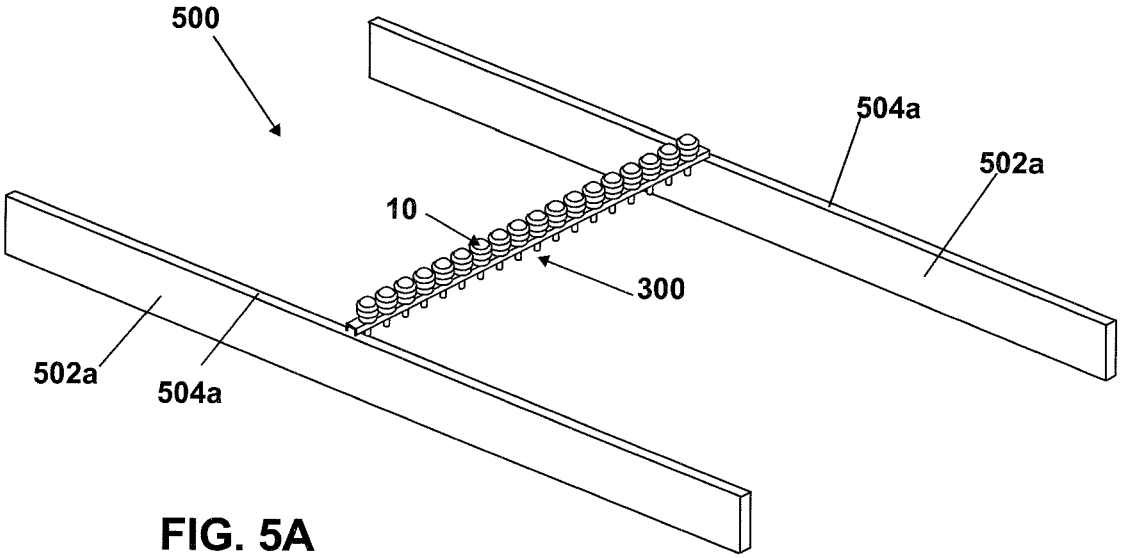
FIGS. 5A, 5B, 5C, and 5D are perspective view illustrations of the ball transfer unit block of FIGS. 3A to 3D mounted onto a base frame, according to four different embodiments of the present invention.
Figure 5B:
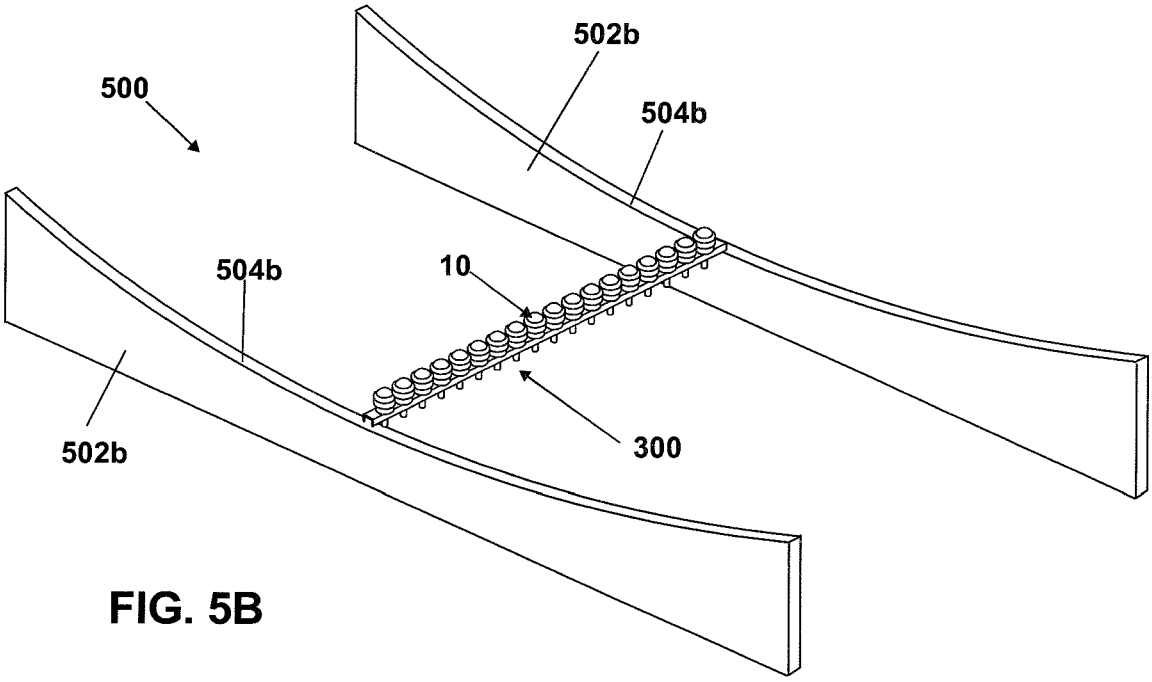
Figure 5C:
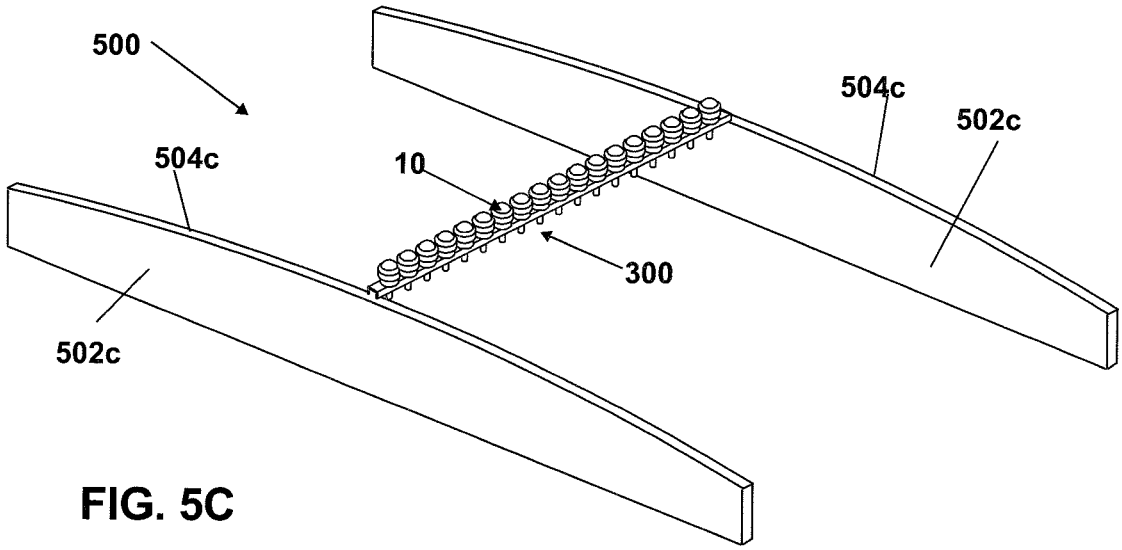
Figure 5D:
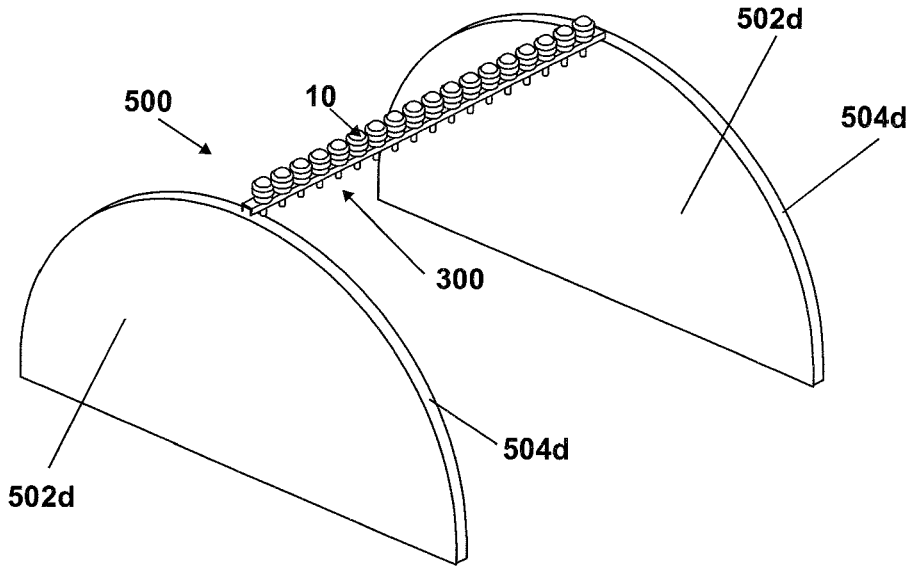

In the embodiment of FIG. 5A, frame walls 502*a* each have a flat, or horizontal, upper edge 504*a*. In the embodiment of FIG. 5B, frame walls 502*b* each have a concave upper edge 504*b*. In the embodiment of FIG. 5C, frame walls 502*c* each have a mildly convex upper edge 504*c*. In the embodiment of FIG. 5D, frame walls 502*d* are hemispherical, and as such define a convex or hemispherical edge 504*d*.

In all the illustrated embodiments, the ball transfer unit block 300 is placed at the center of the frame walls. However, it is appreciated that the ball transfer unit block 300 may be disposed anywhere along the edge of the frame wall, regardless of the curvature, or lack thereof, of the edge of the frame wall.

The ball transfer unit block 300 may be connected to the frame walls by any suitable means. In some embodiments, the frame walls included dedicated tracks, and the bracket 200 of the ball transfer unit 300 may be seated in, or snap fit into, the dedicated tracks. In other embodiments, the bracket 200 of the ball transfer unit 300 may be disposed upon the edge of the frame wall, and may be secured thereto by any suitable means, such as adhesive, soldering, nuts and bolts, nails, and the like.

Figure 6A:
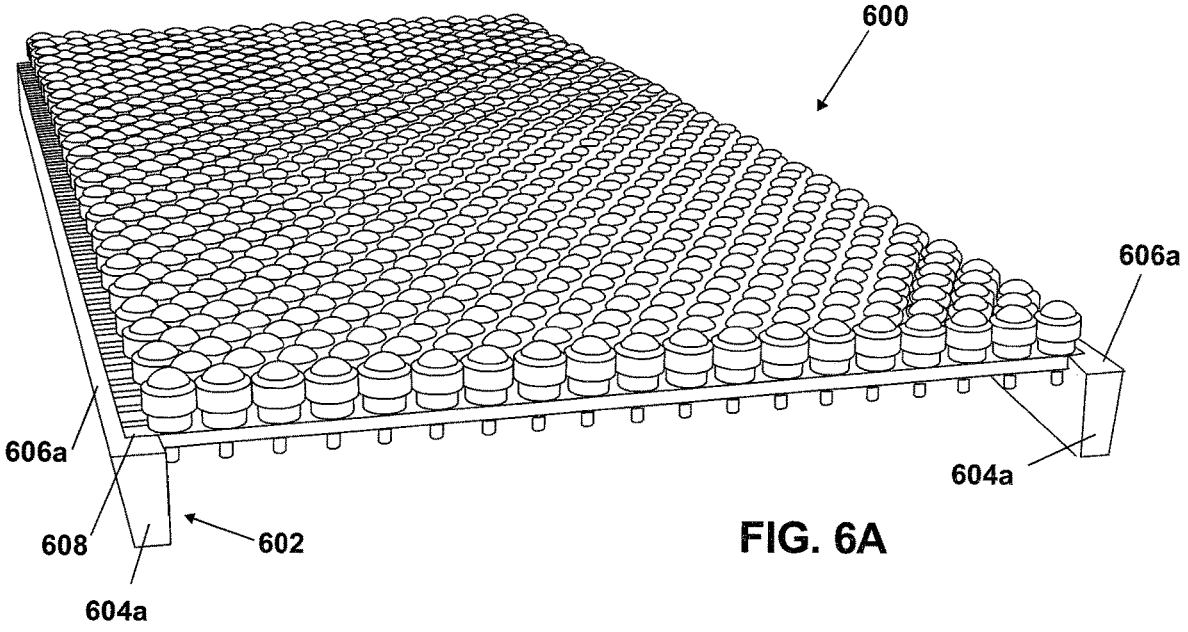
FIGS. 6A and 6B are perspective view illustrations of a flat massage surface formed of a plurality of ball transfer unit blocks of FIGS. 3A to 3D mounted onto a linear base frame, where in FIG. 6A the linear surface base the ball transfer unit blocks are disposed in a dedicated track within the base frame, and in FIG. 6B the ball transfer unit blocks are disposed above the base frame.
Figure 6B:
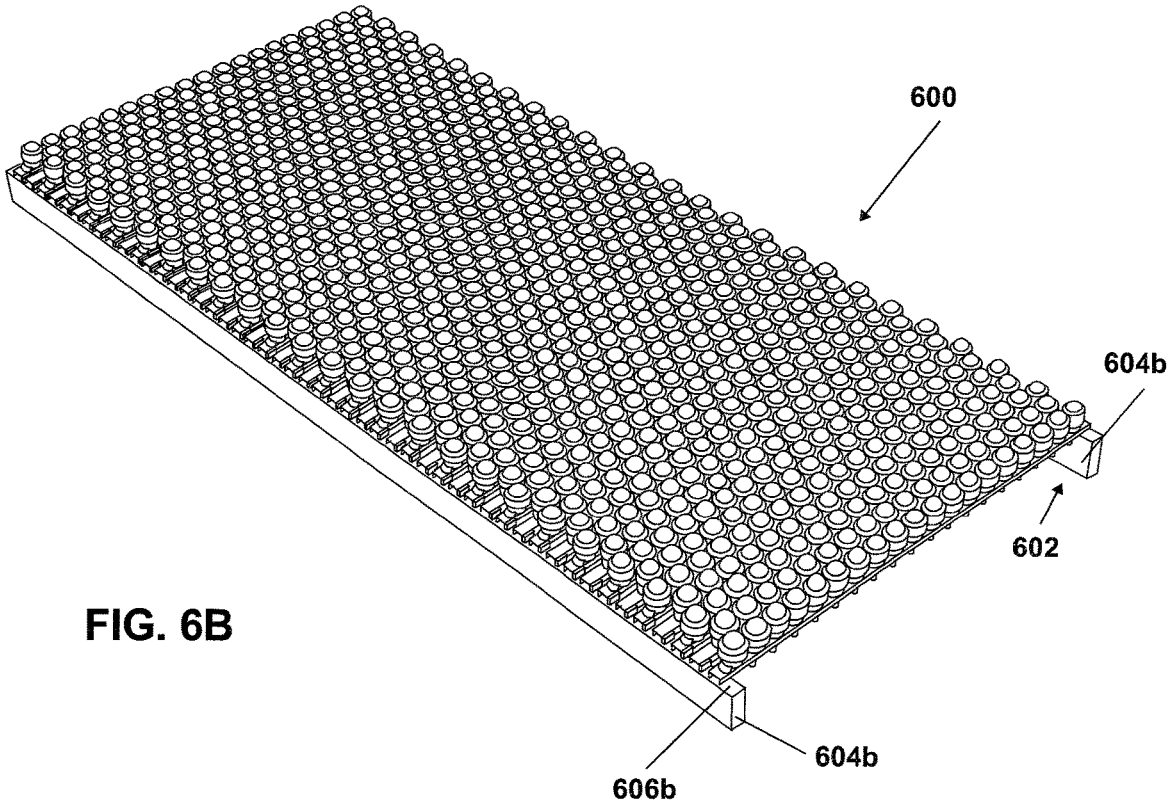

Reference is now made to FIGS. 6A and 6B, which are perspective view illustrations of a flat massage surface formed of a plurality of ball transfer unit blocks 300 mounted onto a linear base frame.

As seen in FIGS. 6A and 6B, massage surfaces 600 thereof each include a plurality of ball transfer unit blocks 300, arranged similarly to the arrangement shown in FIG. 4, mounted onto a base frame 602. Specifically, the ball transfer unit blocks 300 are arranged such that the brackets 200 thereof are disposed in parallel to one another, and the ball transfer units 10 of adjacent blocks 300 engage each other in a honeycomb structure.

In the embodiment of FIG. 6A, the base frame 602 includes a pair of frame walls 604*a* each including a planar, horizontal, upper surface 606*a*. A channel 608 is disposed along each of frame walls 604*a*, slightly beneath upper surface 606*a*, the channel defining a resting surface upon which rest the brackets 200 of the ball transfer unit blocks 300.

In the embodiment of FIG. 6B, the base frame 602 includes a pair of frame walls 604*b* each including a planar, horizontal, upper surface 606*b*. The brackets 200 of ball transfer unit blocks 300 rest directly on upper surface 606*b*.

As discussed hereinabove, the brackets 200 may be secured to their resting surface, be it the channel 608 or the upper surface 606*b*, using any suitable means, such as adhesive, soldering, nuts and bolts, nails, and the like.

Figure 7A:
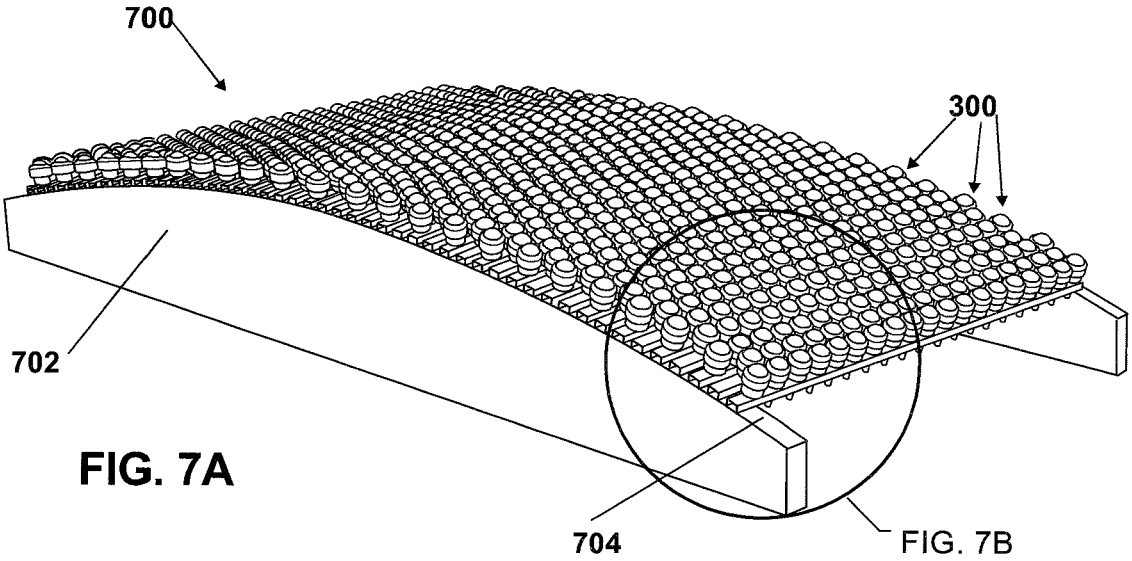
FIGS. 7A and 7B are perspective view illustrations of a convex massage surface formed of a plurality of ball transfer unit blocks of FIGS. 3A to 3D mounted onto a convex base frame, FIG. 7B being an enlargement of a portion of FIG. 7A.
Figure 7B:
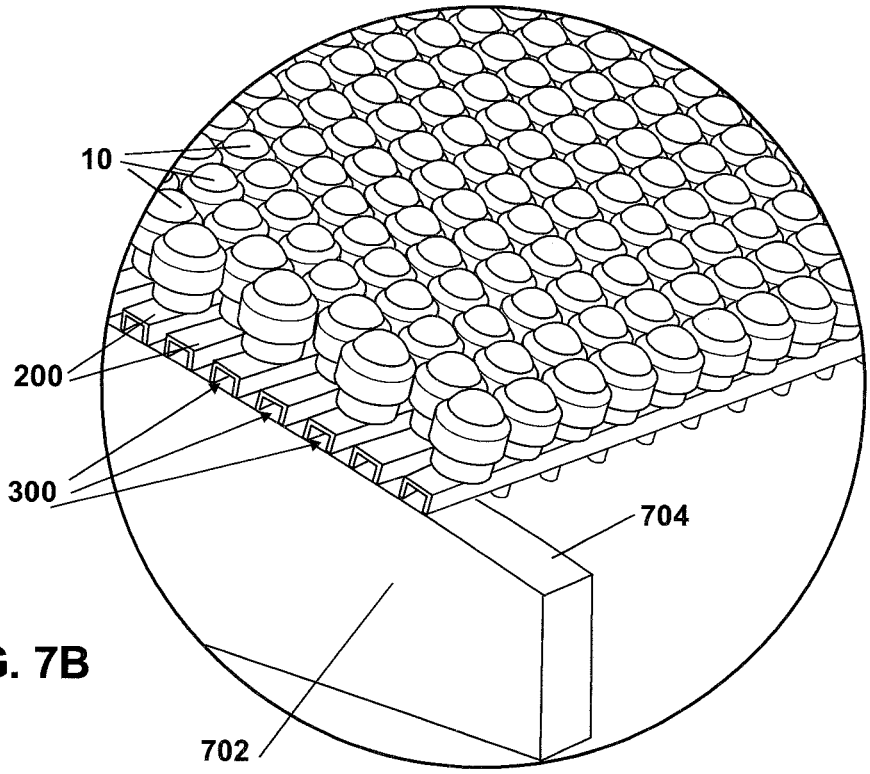

Reference is now made to FIGS. 7A and 7B, which are perspective view illustrations of a convex massage surface 700 formed of a plurality of ball transfer unit blocks 300 mounted onto a convex base frame, FIG. 7B being an enlargement of a portion of FIG. 7A.

As seen, the convex massage surface 700 includes two frame walls 702, each terminating, at an upper end thereof, in a convex surface 704. A plurality of ball transfer unit blocks 300, arranged similarly to the arrangement shown in FIG. 4, mounted onto a convex surface 704. Specifically, the ball transfer unit blocks 300 are arranged such that the brackets 200 thereof are disposed in parallel to one another, and the ball transfer units 10 of adjacent blocks 300 engage each other in a honeycomb structure.

Figure 8:
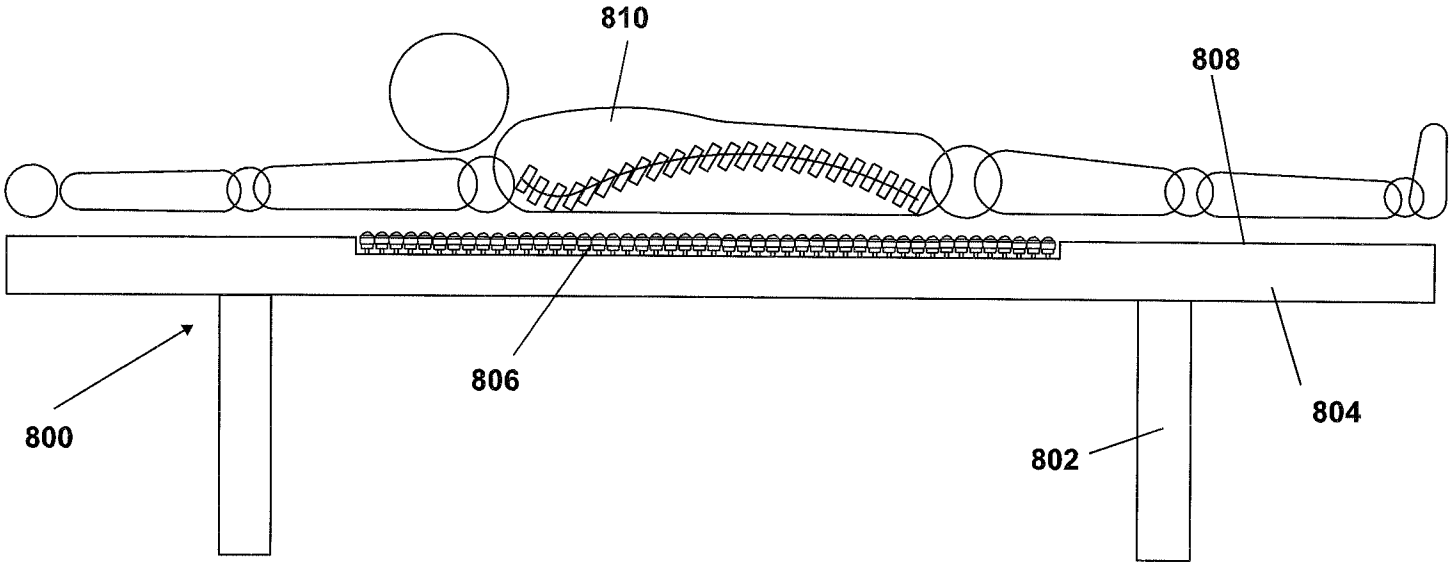
FIG. 8 is a schematic illustration of using a massage table including the flat massage surface of FIG. 6A or 6B to stretch the spine of a subject lying on the massage table.

Turning now to FIG. 8, the Figure is a schematic illustration of a massage table 800 including a flat massage surface, similar to the massage surfaces shown in FIGS. 6A and 6B, being used to stretch the spine of a subject lying on the massage table.

As seen in FIG. 8, the massage table 800 includes table supports 802, which may be table legs as known in the art, and a table plate 804. Table plate 804 includes, in a portion thereof, a flat massage surface 806, which may be similar to massage surfaces 600 described hereinabove with reference to FIGS. 6A and 6B. Other portions of table plate 804 do not define a massage surface, and have a flat or horizontal upper surface 808. In some embodiments, the motion transfer balls of the massage surface 806 are disposed above upper surface 808. In other embodiments, the motion transfer balls are flush with upper surface 808.

The massage table 800 is usable to promote relaxation of muscles, and consequently, straightening and decompression of the spine. In the illustrated embodiment, a user 810 is lying on table plate 804 such that at least a torso thereof is disposed above massage surface 806. In some embodiments, the massage surface 806 is constructed such that the user's body only engages the motion transfer balls 140, and does not touch the housing elements 110 of the ball transfer units 10.

Placement of the user's body on the flat massage surface, which has reduced friction as described hereinabove, allows the body and the spine to straighten due to the impact of gravity on the body. Specifically, as explained hereinabove, the massage surface 806 is constructed such that the ball transfer units 10 are attached to the brackets 200 without limiting the movement of ball bearings 130 or of motion transfer ball 140, and each motion transfer ball 140 is capable of omnidirectional movement irrespective of movement of other ball transfer units. When the torso of user 810 is placed on the massage surface 806, relative motion of the ball transfer units 10 results in spreading out of the mass of the user's torso on the massage surface 806, or stretching the user's torso, in a similar manner to that of rolling out dough on a surface dusted with flour. When using massage table 800, simply turning the body of user 810 body on its side, on its stomach or on its back, you can achieve such a stretching effect for all areas of the spine and surrounding the spine.

Additionally, carrying a traditional massage, applied by a massage therapist or other person while user 810 lies on massage table 800, may enhance the stretching effect described above. This may be due to the fact that, as a result of the massage, the muscular framework surrounding and supporting the spine will relax, and slight pressure applied to the body during the massage promotes even greater spreading of the body and the spine along the table surface. Consequently, decompression of the spine will increase.

Furthermore, each of the ball transfer units 10 may function as an individual massage point, in part due to the fact that the motion of motion transfer ball 140 of each ball transfer unit 10 is capable of omnidirectional rotation independent of the motion of any other ball or ball transfer unit. As such, when the torso of user 810 is placed on the massage surface 806, each ball transfer unit provides a separate massage point, such that a massage of multiple points, similar to a "shiatzu massage" occurs in parallel.

In some embodiments, the massage table 800, and specifically the massage surface 806, may further include one or more vibrational elements and a control mechanism for adjusting the amplitudes and periods of vibration of the vibrational elements. Vibration of the ball transfer units 10 during placement of the user's body thereon may further decompress the spine, and enhance the muscle relaxation effects of the massage.

In some embodiments, the planar massage surface 806 may be replaced by a convex massage surface, similar to that shown in FIGS. 7A and 7B. A convex massage surface allows for a greater stretching force due to stretching of the muscles to conform to the shape of the surface, and as a result, to a higher degree of decompression of the spine. Additionally, on a convex massage surface, it is possible not only to straighten the spine, but also to bend the spine in a desired direction.

In some embodiments, a physical activity may be performed on the massage table, the physical activity including at least one of massage, sports exercise, medical exercise, muscle rehabilitation exercise, joint rehabilitation exercise, spinal decompression, and post-traumatic rehabilitation. The reduced friction provided by the massage surface may enable the user to invest less force in such physical activity, thereby resulting in the user achieving a greater range of motion and/or conserving more energy while carrying out the physical activity.

Figure 9A:
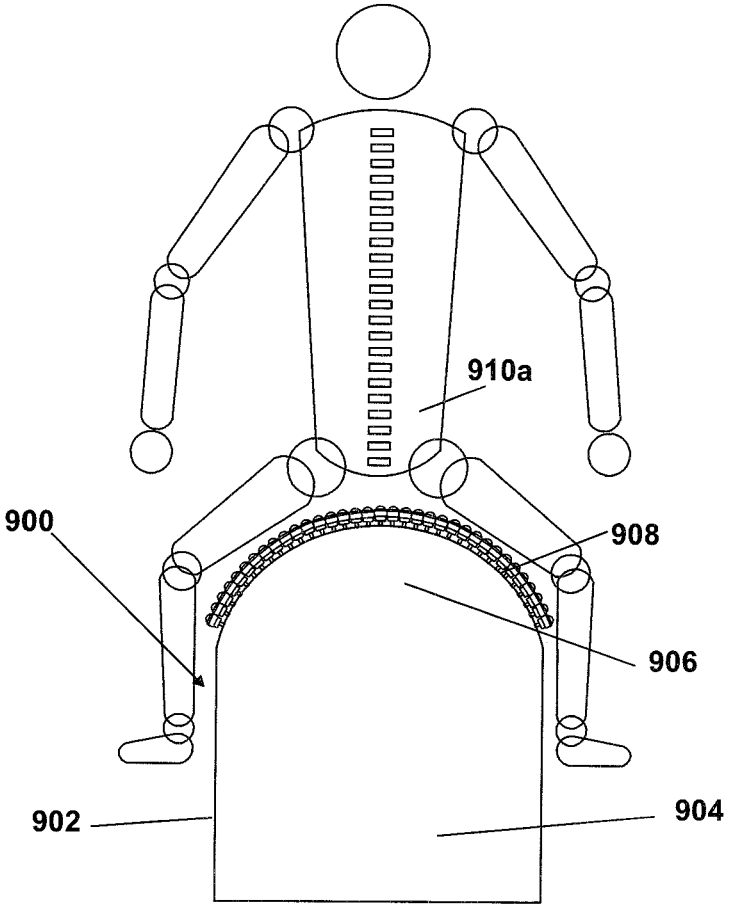
FIGS. 9A and 9B are schematic illustrations of using a convex massage barrel constructed according to the present invention, to stretch the hip joints of a human subject straddling the massage barrel and to stretch the spine of a subject lying on the massage barrel.
Figure 9B:
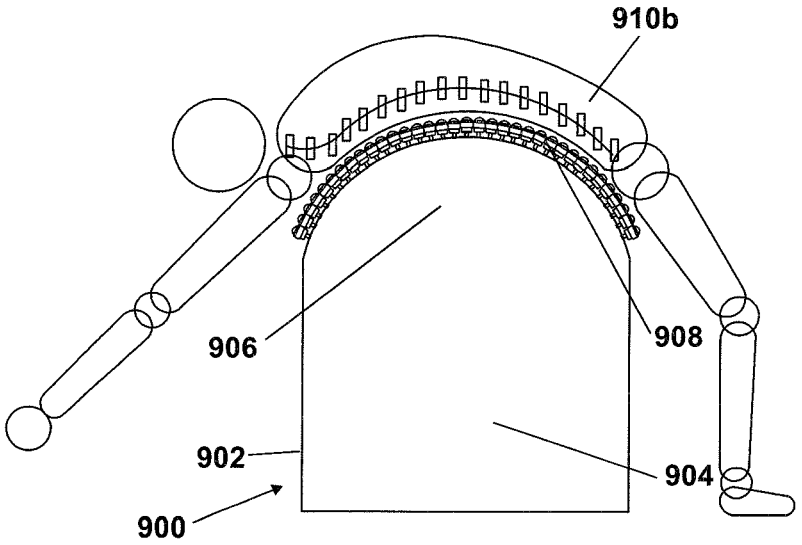

FIGS. 9A and 9B are schematic illustrations of using a convex massage barrel 900 constructed according to the present invention, to stretch the hip joints of a human subject straddling the massage barrel and to stretch the spine of a subject lying on the massage barrel.

As seen, convex massage barrel 900 is formed of a base frame 902 including frame walls, each including a quadrilateral portion 904, and a convex portion 906. Mounted onto the convex portion 906 of the base frame 902 is a massage surface 908, including a plurality of ball transfer unit blocks 300, substantially as described hereinabove with respect to FIGS. 7A and 7B. Massage barrel 900 is particularly characterized in having substantially large curvature of convex portion 906. In some embodiments, the radius of curvature of convex portion 906 is in the range of 10 to 20 inches.

Turning specifically to FIG. 9A, a user 910*a* is straddling massage surface 908, such that the hips of the user engage massage surface 908, and the user's legs hang down alongside quadrilateral portion 904. In this position, the user's hip joints are stretched. This is particularly due to the fact that the reduced friction allows the user's legs to extend downward with gravity, without the user having to apply force to overcome the friction between the massage barrel and his body. Additionally, if weights are placed on the legs, and the user swings the legs back and forth, no burden is applied to the legs while restoring and strengthening ligaments and muscles that ensure the operability of the hip joint.

In FIG. 9B, a user 910*b* is lying over the barrel such that his torso is aligned with the massage surface 908. It is appreciated that placing a user's body on a strongly curved surface, such as massage surface 908, greatly increases the degree of decompression action on the spine relative to when using a flat massage surface, regardless of whether the user is on his stomach, back, or side. Stretching of the spine on such a curved surface, even without additional load (known as passive stretching), also provides greater decompression of the spine than when using a massage surface having lower curvature. Performance of physical exercises on massage barrel 900, when the body is forced from a curved positon to a horizontal position by forces of the muscles, or when the body bends in the opposite direction to the curvature of the barrel 900 (as in a sit-up), is designed to reinforce and/or fix the effect of decompression of the spine, and to strengthen the muscular corset surrounding the spine.

The reduced friction of massage surface 908, stemming from use of ball transfer units, is advantageous when using a massage barrel for similar reasons to those described hereinabove with respect to FIG. 8, such as for the effect of spreading out the spine, and for the creation of multiple pressure points.

Figure 10A:
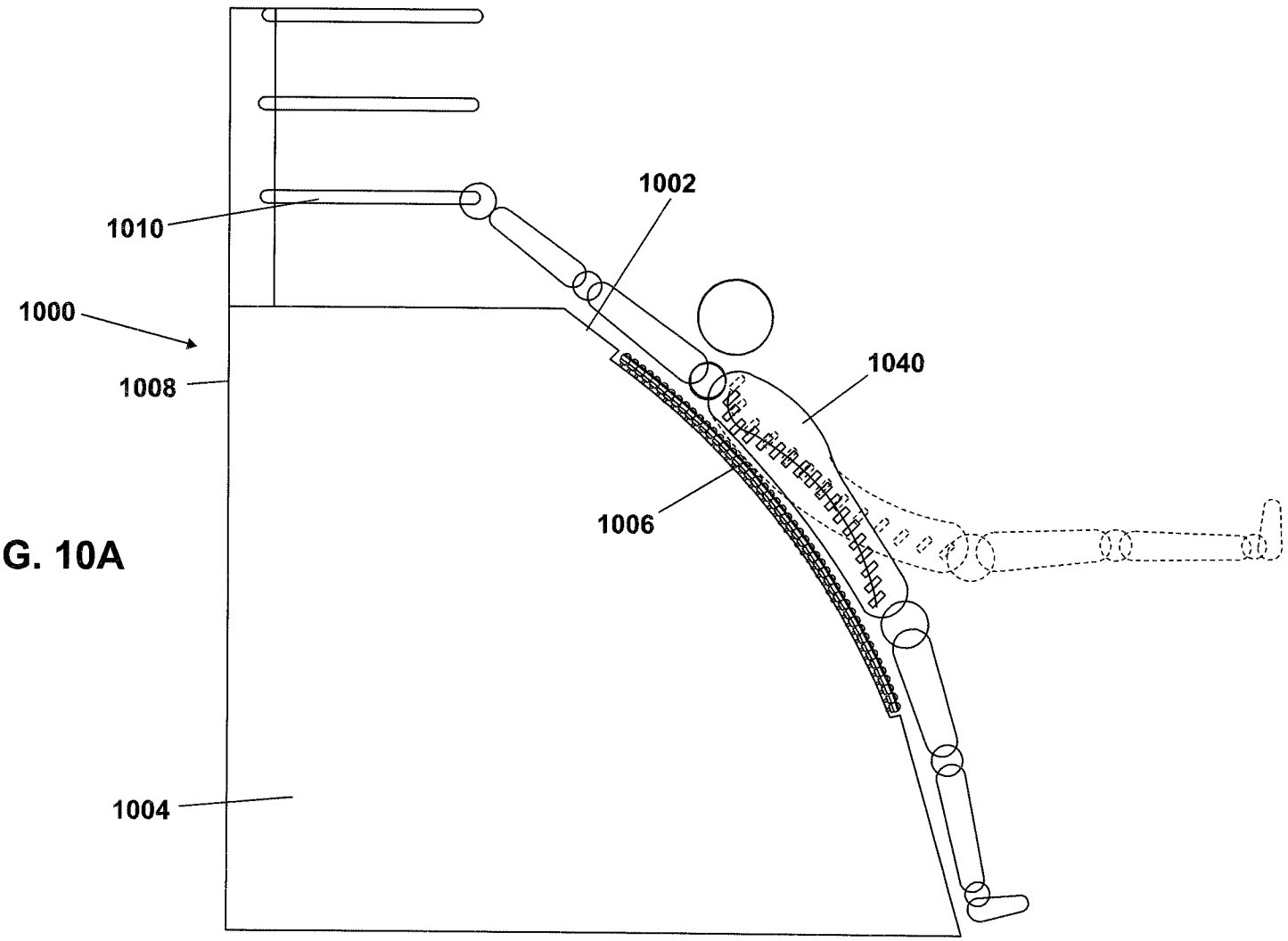
FIGS. 10A and 10B are schematic illustrations of using a massage surface, constructed according to the present invention, for performing exercises and stretching the spine of a human subject against gravity, where in FIG. 10A the massage surface is convex, and in FIG. 10B the massage surface is flat.
Figure 10B:
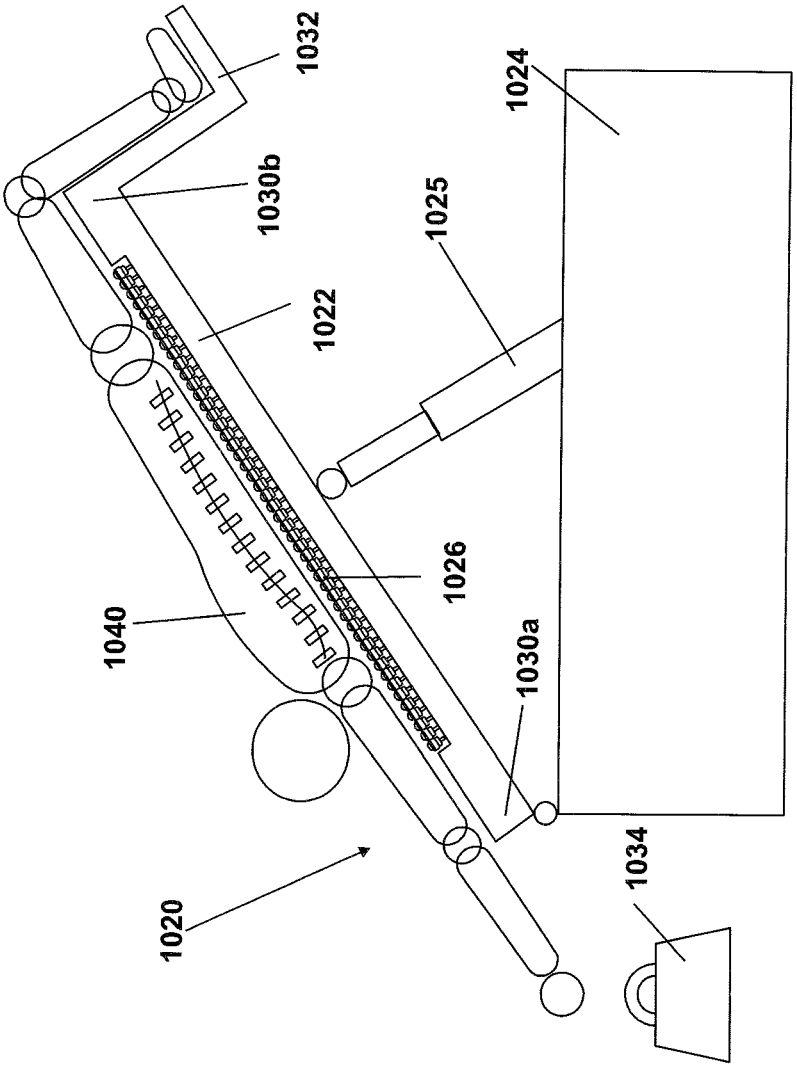

FIGS. 10A and 10B are schematic illustrations of using a massage surface, constructed according to the present invention, for performing exercises and stretching the spine of a human subject against gravity, where in FIG. 10A the massage surface is convex, and in FIG. 10B the massage surface is flat.

As seen in FIG. 10A, an exercise machine 1000, which may, for example, be a "Swedish wall", has a convex surface 1002 which is elevated from the ground by a base portion 1004. A massage surface 1006, similar to the massage surfaces of FIGS. 6A to 7B, is disposed on a portion of convex surface 1002. Attached to a bottom surface 1008 of base portion 1004 are a plurality of loads or anchors 1010, which may be held or manipulated by a user.

FIG. 10B illustrates massage table 1020 which includes a flat table 1022 mounted onto a base portion 1024 via an elevation mechanism 1025. Table 1022 is substantially similar to table plate 804 of FIG. 8, and includes a planar massage surface 1026, which may be similar to massage surfaces 600 of FIGS. 6A and 6B. In some embodiments, table 1022 includes first and second ends 1030*a* and 1030*b*, and an L-shaped leg rest 1032 is connected to second end 1030*b*, and hangs downwardly therefrom.

The elevation mechanism 1025 is adapted to elevate at least a portion of table 1022 relative to base portion 1024, and may be hydraulic, pneumatic, or any other suitable type of elevation element. In the illustrated embodiment, table 1022 is elevated such that first end 1030*a* engages the base portion 1024, and leg rest 1032 is elevated in the air above the base portion. As such, in the embodiment of FIG. 10B, table 1022 is slanted relative to base portion 1024. Free standing weights, such as kettle ball 1034, dumbbells, or other weights may be disposed adjacent massage table 1020 for use during treatment thereon.

Exercise machine 1000 of FIG. 10A and massage table 1020 of FIG. 10B are used in a similar manner. A user 1040 lies on convex surface 1002 or on an upper surface of table portion 1022, such that at least a torso thereof is disposed on the massage surface 1006 or 1026. In the embodiment of FIG. 10A, the user 1040 lies on the surface 1002 such that the head thereof is disposed higher than the knees, whereas in the embodiment of FIG. 10B, the user lies on the surface 1022 such that the head of the user 1040 is disposed lower than the knees of the user, and the user is facing "down-hill" on the device relative to the horizontal plane.

The devices of FIGS. 10A and 10B are designed for passive (no added load) and active (with added loads) decompression of the spine and restoration of the mobility of the musculoskeletal system. Using the devices 1000 and 1020, stretching and/or decompression of the spine is achieved by placing the human body on the reduced friction surface defined by massage surface 1006 or 1026, while the reduced friction surface is inclined relative to the horizontal plane. The body of the user 1040 is fixed to the inclined surface, for example by holding anchors 1010 of device 1000 of FIG. 10A, or by anchoring the shins of the user to the leg-rest 1032 of massage table 1020 of FIG. 10B. Such fixation does not allow the user to slip along the reduced friction surface 1006 or 1026 under the gravitational force, while assisting in stretching the spasmodic muscles and decompressing and/or stretching the spine and joints. The degree of stretching and decompression can be adjusted by adjusting one or more of the following:

an angle of inclination of reduced friction surface on which the human body is placed—this adjusts the passive decompression; and a load pulling down any part of the body below the point at which the body is fixed to the inclined surface—this adjusts active decompression.

Various physical exercises may be carried out on the devices of FIGS. 10A and 10B, when the user's body is downwardly inclined and vertical loads are removed from the spine and joints may include:

pull ups when holding an anchor, such as anchors 1010;

lifting the legs and bending the torso, as illustrated by dashed lines in FIG. 10A;

flexion and extension of the torso; and hand work with free loads, such as kettlebells or dumbbells 1034 illustrated in FIG. 10B.

More generally, at a time when the spine and joints are in a stretched state, any additional decompression action exerted or carried out helps to restore the mobility of the musculoskeletal system.

Figure 11A:
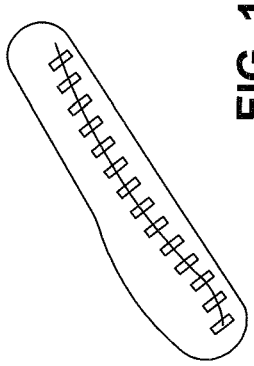
FIGS. 11B and 11A schematically represent the human spine in the compressed state and in the stretched (decompressed) state, respectively.
Figure 11B:
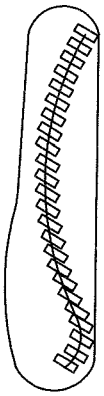

Reference is now made to FIGS. 11A and 11B, which are schematically represent the human spine in the compressed state and in the stretched (decompressed) state, respectively. Comparison of FIG. 11A, in which the user's torso is inclined and the spine is well stretched, to FIG. 11B, in which the user's torso is horizontal, or laying on a flat surface, and the vertebrae of the spine remain very close to one another, illustrates the advantages of using the systems of FIGS. 10A and 10B for spinal decompression, as compared to using a massage table having a flat surface, such as the massage table of FIG. 8.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. A reduced friction device for applying force to a body part of a human user, the device comprising:

a base frame; and a reduced friction surface mounted onto said base frame, said reduced friction surface comprising:

a plurality of ball transfer unit blocks, each ball transfer unit block including:

a bracket; and a set of multiple ball transfer units mounted onto said bracket, such that in each said ball transfer unit block, each ball transfer unit engages ball transfer units of said set which are adjacent thereto, wherein each pair of adjacent ones of said plurality of ball transfer unit blocks are longitudinally offset from each other, such that at least two ball transfer units in at least one of said plurality of ball transfer unit blocks engages six other ball transfer units disposed there-around, wherein each ball transfer unit in each said set of ball transfer units includes a housing element housing a motion transfer ball wherein each of said motion transfer balls of each of said sets of ball transfer units is adapted for omnidirectional rotation relative to a corresponding said housing element and independently of other said motion transfer halls, and wherein said reduced friction surface is adapted to have the body part placed thereon during performing of a physical activity applying force to the body part, while minimizing friction between the body part and the surface.

2. A reduced friction device according to claim 1, wherein each of said plurality of ball transfer unit comprises:

said housing element, which includes:

a solid, non-hollow base portion having a concave upper surface; and a cylindrical portion extending from said base portion around said concave upper surface and forming a hollow cup;

a coating disposed within said hollow cup at least on said concave upper surface, said coating formed of a material having a low friction coefficient;

a plurality of ball bearings disposed within said hollow cup in engagement with said coating; and said motion transfer ball disposed at least partially within said hollow cup in engagement with said plurality of ball bearings, wherein said motion transfer ball is free to rotate in any direction relative to said hollow cup with substantially no friction, and wherein a hardness of said coating is equal to or greater than a hardness of a material from which said plurality of ball bearings are formed.

3. A reduced friction device according to claim 2, wherein said housing element further includes an elongate stem extending from one end thereof opposite to said non-hollow base portion.

4. A reduced friction device according to claim 1, wherein each of said motion transfer ball is formed of at least one of metal, plastic, wood, glass, or bone.

5. A reduced friction device according to claim 1, wherein all said motion transfer balls are formed of a single material, said single material being selected from the group consisting of metal, plastic, wood, glass, or bone.

6. A reduced friction device according to claim 1, wherein all said motion transfer balls have an equal diameter.

7. A reduced friction device according to claim 1, wherein said physical activity comprises at least one of sports exercise, medical exercise, muscle rehabilitation exercise, joint rehabilitation exercise, spinal decompression, and post-traumatic rehabilitation and massage.

8. A reduced friction, device according to claim 1, wherein said housing elements and said ball transfer units in each of said sets of ball transfer units are dimensioned and arranged such that the body part placed on said surface engages only the motion transfer balls and does not engage the housing, elements or the brackets between said housing elements.

9. A reduced friction device according to claim 1, wherein said ball transfer units are arranged such that a load of the body part is substantially equally distributed among ones of said motion transfer balls disposed beneath the body part.

10. The reduced friction device of claim 1, wherein said at least two of said ball transfer units of the at least one of said plurality of ball transfer unit blocks form a honeycomb structure.

11. An exercise barrel including a reduced friction device according to claim 1, wherein said base frame comprises frame walls, each including a quadrilateral portion and a convex portion, Wherein a radius of curvature of said convex portion is within a range of 10 to 20 inches, wherein said reduced friction surface comprises a convex surface mounted onto said convex portion of said base frame.

12. The exercise barrel of claim 11, wherein said convex surface is adapted to be straddled by said human user such that hips of the human user engage said reduced friction surface and legs of the human user hang down alongside said quadrilateral portions, thereby to stretch the human user's hip joints.

13. The exercise barrel of claim 11, wherein said convex surface is adapted to be engaged by a torso of the human user, thereby to increase a degree of decompression action on a spine of the human user relative to when the human user is on a flat surface.

14. An exercise machine including:

a base portion;

a reduced friction device according to claim 1, said reduced friction surface terminating, at one end thereof, in a transverse wall from which extends a footrest, said footrest disposed parallel to said reduced friction surface; and a pneumatic or hydraulic elevation mechanism attached to said base portion and to said base frame of said reduced friction device, said elevation mechanism being adapted to elevate at least a portion of said reduced friction surface relative to said base portion, so as to angle said reduced friction surface between the body part and the surface at an acute angle such that a distance of said one end of said reduced friction surface including said footrest from said base portion is greater than a distance of an opposing end of said reduced friction surface, wherein said footrest is adapted to fix legs or feet of the human user when said reduced friction surface is inclined.

15. A method of physical activity/exercise of a human user, the method comprising:

providing a reduced friction device according to claim 1;

placing the body part of the human user on said reduced friction surface; and while the body part engages said reduced friction surface, performing a physical activity on the body part.

16. The method of claim 15, wherein said performing a physical activity comprises performing at least one of sports exercise, medical exercise, muscle rehabilitation exercise, joint rehabilitation exercise, gravitational spinal decompression, and post-traumatic rehabilitation exercise.

17. The method of claim 15, further comprising, prior to said placing the body part, angling said reduced friction surface relative to a horizontal base surface, and wherein said performing a physical activity comprises performing said physical activity while said reduced friction surface is leveled or angled relative to said horizontal base surface.

18. An exercise machine including:

a base portion;

a convex surface, elevated from the ground by said base portion;

the reduced friction device according to claim 1, wherein said base frame of said reduced friction device is a portion of said convex surface, such that said reduced friction surface is a convex reduced friction surface; and at least one anchor or at least one load, attached to a bottom surface of said base portion, wherein, during use, said convex reduced friction surface is adapted to engage a torso of a human subject, such that a head of the human subject is disposed at a higher elevation than legs of the human subject, and to engage or manipulate said at least one anchor or said at least one load, thereby to cause stretching of muscles or spinal decompression.

* * * * *